US006655231B2

(12) United States Patent
Willemsen

(10) Patent No.: US 6,655,231 B2
(45) Date of Patent: Dec. 2, 2003

(54) PEDAL ADJUSTER FOR ELECTRONIC THROTTLE CONTROL

(75) Inventor: Larry G. Willemsen, Morpeth (CA)

(73) Assignee: KSR Industrial Corporation, Southfield, MI (US)

( * ) Notice: Subject to any disclaimer, the term of this patent is extended or adjusted under 35 U.S.C. 154(b) by 0 days.

(21) Appl. No.: 10/080,006

(22) Filed: Feb. 21, 2002

(65) Prior Publication Data

US 2002/0112562 A1 Aug. 22, 2002

Related U.S. Application Data

(60) Provisional application No. 60/270,458, filed on Feb. 21, 2001.

(51) Int. Cl.[7] ..... G05G 1/14
(52) U.S. Cl. ..... 74/512; 74/560
(58) Field of Search ..... 74/512, 560, 563, 74/564, 578.5

(56) References Cited

U.S. PATENT DOCUMENTS

| | | | | |
|---|---|---|---|---|
| 4,528,590 A | | 7/1985 | Bisacquino et al. | 338/153 |
| 4,883,037 A | | 11/1989 | Mabee et al. | 123/399 |
| 4,915,075 A | | 4/1990 | Brown | 123/399 |
| 4,938,304 A | | 7/1990 | Yamaguchi et al. | 180/197 |
| 4,958,607 A | | 9/1990 | Lundberg | 123/399 |
| 4,969,437 A | | 11/1990 | Kolb | 123/399 |
| 4,986,238 A | | 1/1991 | Terazawa | 123/361 |
| 5,063,811 A | | 11/1991 | Smith et al. | 74/513 |
| 5,215,057 A | | 6/1993 | Sato et al. | 123/400 |
| 5,233,882 A | | 8/1993 | Byram et al. | 74/514 |
| 5,241,936 A | | 9/1993 | Byler et al. | 123/399 |
| 5,385,068 A | | 1/1995 | White et al. | 74/512 |
| 5,460,061 A | | 10/1995 | Redding et al. | 74/512 |
| 5,632,183 A | | 5/1997 | Rixon et al. | 74/512 |
| 5,819,593 A | * | 10/1998 | Rixon et al. | 74/514 |
| 5,887,488 A | | 3/1999 | Riggle | 74/514 |
| 5,927,154 A | * | 7/1999 | Elton et al. | 74/512 |
| 6,019,015 A | * | 2/2000 | Elton | 74/513 |
| 6,073,515 A | * | 6/2000 | Elton et al. | 74/564 |
| 6,109,241 A | | 8/2000 | Engelgau | 123/399 |
| 6,173,625 B1 | | 1/2001 | McFarlane et al. | 74/512 |
| 6,178,847 B1 | * | 1/2001 | Willemsen et al. | 74/512 |
| 6,389,927 B1 | | 5/2002 | Willemsen | 74/514 |

OTHER PUBLICATIONS

1974 Pontiac Service Manual.

* cited by examiner

*Primary Examiner*—David A. Bucci
*Assistant Examiner*—Julie K. Smith

(57) ABSTRACT

A pedal adjuster for electronic throttle control includes a pedal arm and support arm pivotally mounted to a bracket. An electronic throttle control unit is mounted to the bracket at the pivot point of the pedal arm assembly. A screw rod drive mechanism extends in a space formed between the support arm and pedal arm to adjustably position the pedal arm with respect to the support arm. The pedal arm carries an elongated curved pedal. Depression of the pedal pivots the pedal arm assembly to turn a blade connected to the ETC unit to generate a signal indicative of the position of the pedal arm.

8 Claims, 4 Drawing Sheets

PEDAL ADJUSTER FOR ELECTRONIC THROTTLE CONTROL

RELATED APPLICATION

This application claims priority of U.S. Provisional Patent Application No. 60/270,458 filed Feb. 21, 2001, and is incorporated herein by reference.

BACKGROUND OF THE INVENTION

Pedal adjustment systems for vehicles have been used for some time to adjust the position of the pedal with respect to the vehicle operator. In the past, pedal adjustment systems have been generally developed for use with pedals which are mechanically linked to actuators such as brake cylinders, clutches and throttles. Typically, most of these systems are designed to maintain the position of the end of the linkage during adjustment of the pedal position. Examples of such systems are disclosed in U.S. Pat. No. 5,351,573 to Cicotte. In the preferred embodiment of the invention, the electronic control is an electronic throttle control ("ETC").

Developments in engine control technology have led to development of "fly-by-wire" control systems. Fly-by-wire systems include a pedal arm connected to an electronic position sensor which senses the position of the pedal and sends an electrical signal to a control unit indicative of the position of the pedal. Pedal adjuster assemblies for mechanically operated controls are not well suited for adjustment fly-by-wire electronic control systems. Accordingly, it is desirable to have a simple and efficient pedal adjustment system which may be used with electronic throttle controls.

SUMMARY OF THE INVENTION

A pedal adjuster for a pedal assembly with an electronic throttle control includes a pedal arm assembly pivotally mounted to a bracket. The electronic throttle control unit is mounted to the bracket at the pivot point of the pedal arm assembly. The pedal arm assembly includes a pedal arm and a support arm. A screw rod drive mechanism extends in a space formed between the support arm and pedal arm to adjustably position the pedal arm with respect to the support arm. The pedal arm carries an elongated curved pedal. Depression of the pedal pivots the pedal arm assembly to turn a blade connected to the ETC unit to generate a signal indicative of the position of the pedal arm.

DESCRIPTION OF THE DRAWINGS

Further useful details of the invention will be seen from the independent claims and the account now to be given of the different forms of the invention given by way of example only using the figures.

DETAILED DESCRIPTION OF THE PREFERRED EMBODIMENT

Figure 1:
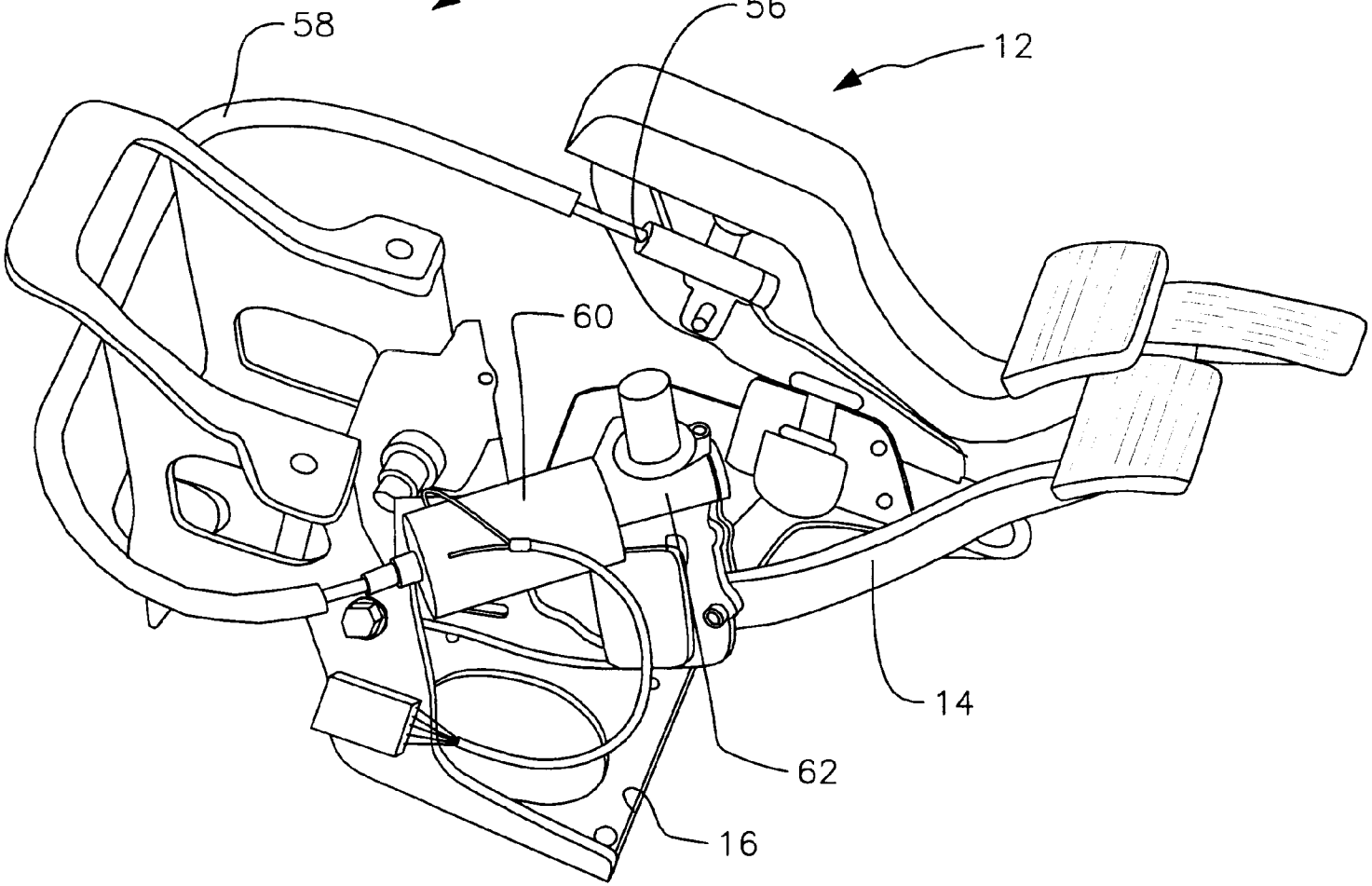
FIG. 1 is a perspective view of a pedal assembly showing a bracket, adjustable fly-by-wire pedal and adjustable brake pedal in accordance with the invention.
Figure 2:
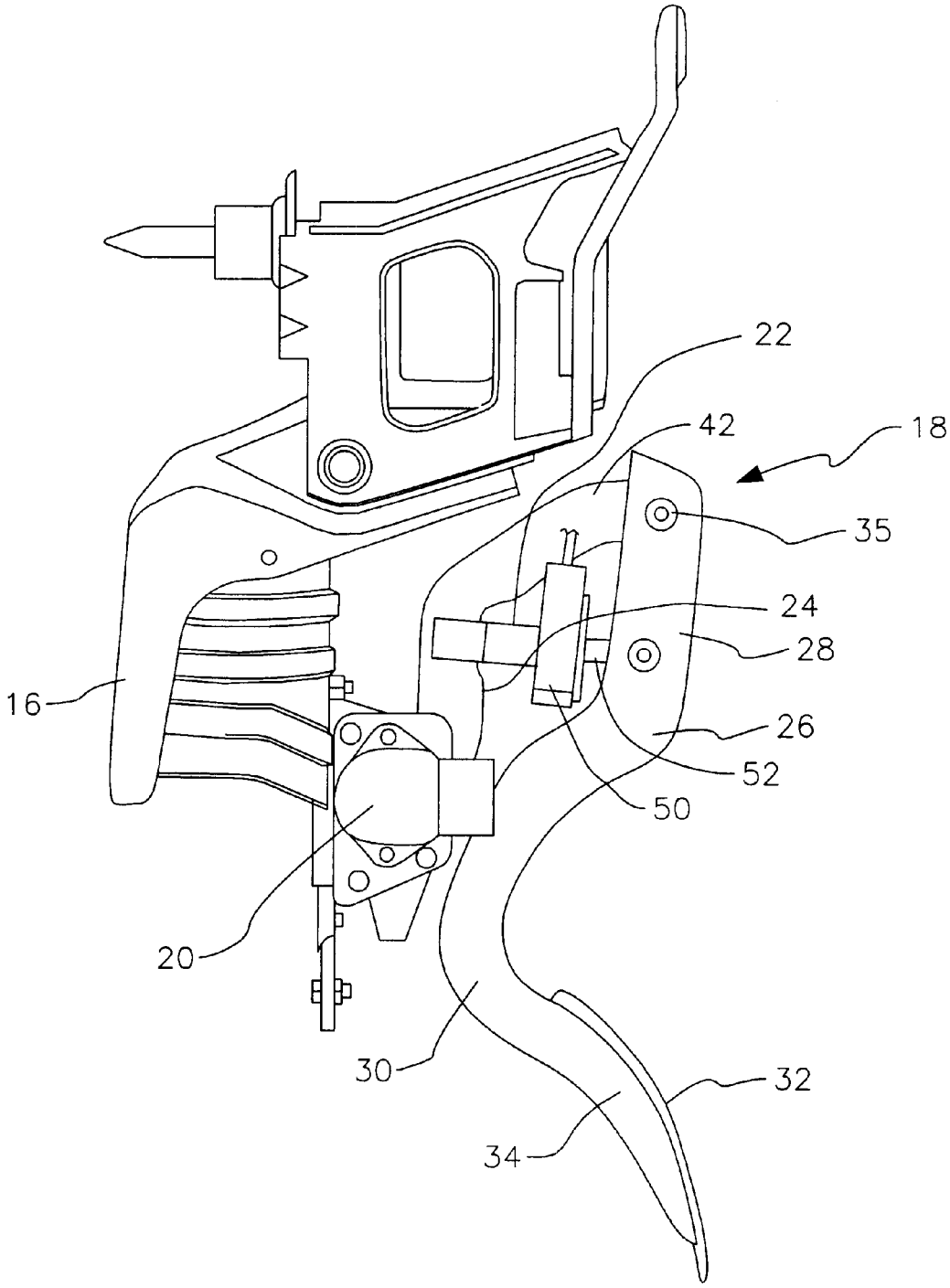
FIG. 2 is a side view of the bracket and adjustable fly-by-wire pedal in accordance with the invention.

A pedal assembly 10 suitable for use with a vehicle is shown in FIGS. 1 and 2. The pedal assembly 10 includes an adjustable throttle pedal assembly 12 and an adjustable brake pedal assembly 14 mounted to a bracket 16. The bracket 16 is fixedly mounted to the vehicle as is known in the art. The throttle control pedal assembly 12 includes a pedal arm assembly 18 connected to a conventional electronic throttle control unit (ETC) 20. The ETC 20 generates a signal indicative of the position of a pedal throughout the range of depression. The signal is delivered to a CPU (not shown) which controls the ignition and fuel supply system to increase or decrease the speed of the engine.

As shown in FIG. 2, the pedal arm assembly 18 includes a screw rod drive assembly 22 which extends between a support arm 24 and pedal arm 26. The screw rod drive assembly 22, as discussed below, is operable to adjust the position of the pedal arm with respect to the support arm.

The pedal arm 26 has a vertically extending upper portion 28 and a C-shaped lower portion 30 having a lower end 34 supporting an elongated pedal 32. The upper portion 28 is pivotally mounted to the support arm 24 by a pin 35. The lower portion 30 of the pedal arm curves first to the bracket under the drive assembly 22 and then rearwardly to support the pedal 32.

As shown in FIG. 2, support arm 24 has a lower portion 40 and an upper portion 42. The lower portion extends upwardly to parallel the upper portion 28 of the pedal arm 26. The upper portion 42 extends rearwardly over the drive assembly 22 to support the pedal arm 26.

Figure 4:
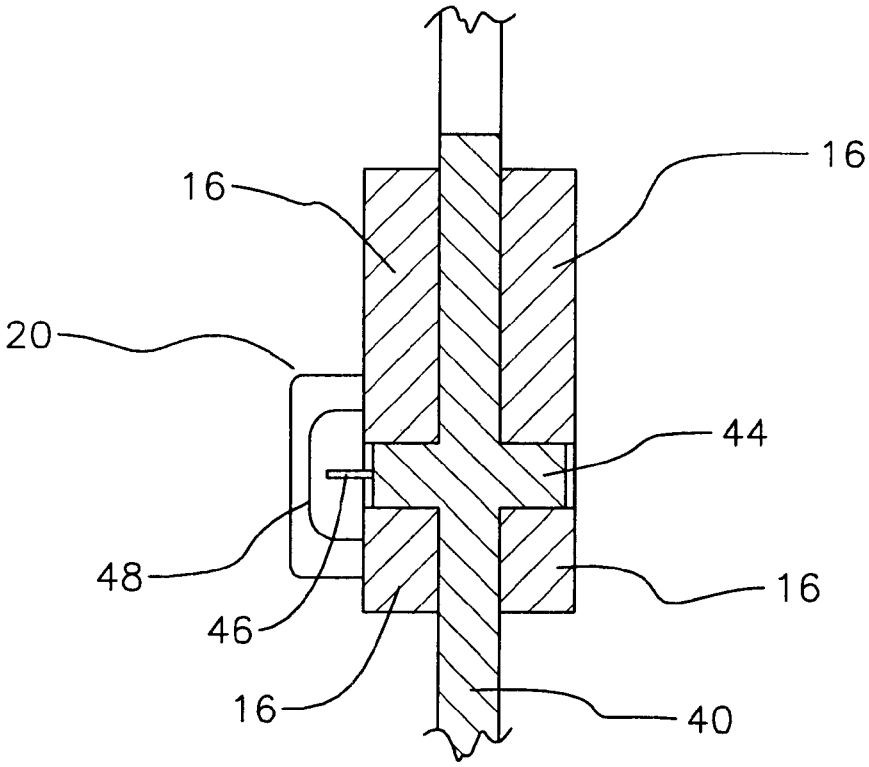
FIG. 4 is an end view of the intermediate pedal arm and electric control unit in accordance with the invention.

As shown in FIG. 4, the lower portion 40 of the portion of the support arm has a pair of bosses 44 which are received in apertures in arms of the bracket 16 which support the pedal assembly for pivotal movement when the pedal 32 is depressed. Extending coaxially from one of the bosses 44 is a blade 46 which is received within the ETC unit 20 mounted to the bracket 16. As is known in the art, the blade 46 turns a potentiometer 48 so that movement of the pedal and pedal arm assembly rotates the blade 46 which turns a potentiometer 48 of the sensor 20 to generate an electrical signal proportional to position the pedal. The signal is then carried by a wire harness to a CPU which controls the throttle.

As shown in FIG. 2, the drive assembly 22 extends horizontally between the support arm 24 and the pedal arm 26 in a space formed between the arms 24, 26. The drive assembly 22 includes a housing 50 having a worm, a worm gear and a portion of a screw rod 52. Drive mechanisms of this type are described in U.S. Pat. No. 6,151,986. One end of the screw rod 52 extends from an aperture in the rear of the housing 50 to the pedal arm 28. The other end of the screw rod 52 is received within a threaded bore in a driven worm gear (not shown). The drive worm is mounted in meshing engagement with the driven worm gear. As shown in FIG. 1, the drive worm is connected to a coupling 56 for connection to a flexible drive cable 58 and a remote motor 60.

In the present embodiment, the motor 60 is mounted to the brake pedal adjuster assembly 14 and is also used to drive a screw rod mechanism 62 for adjusting the brake rod. However, the motor 60 can be mounted directly to the accelerator pedal adjustment assembly 12 in the same fashion as with the brake pedal adjuster assembly 14 or at any desired remote location. Activation of the motor 60 turns the drive cable 58 to rotate the worm gear and in turn the driven worm to threadably move the screw rod 52 inwardly and outwardly depending upon the direction of rotation of the motor 60 and gears. Movement of the screw rod 52 pivots the pedal arm 28 rearwardly from a retracted position as shown in FIG. 2 or forwardly to an extended position to place the pedal 32 at a desired location.

Figure 3:
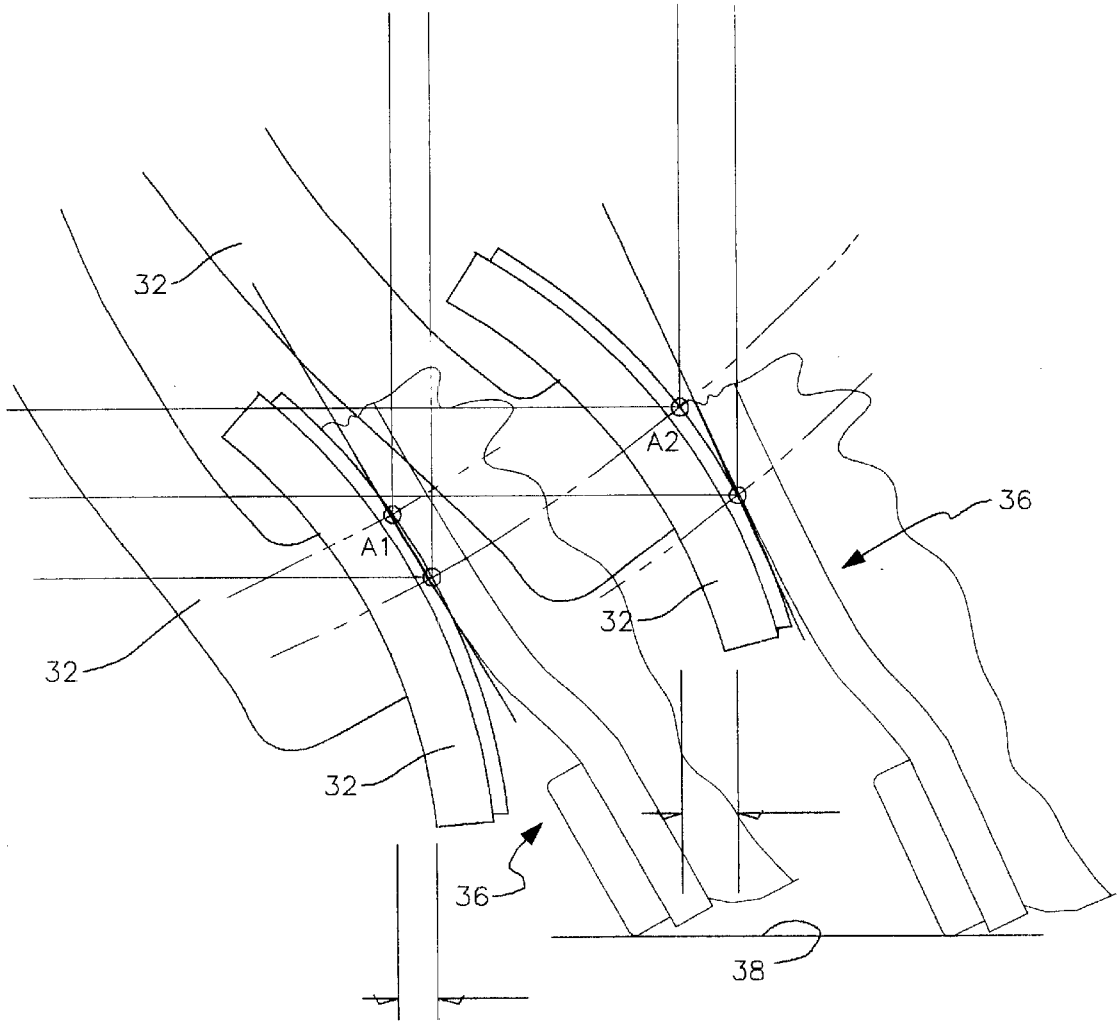
FIG. 3 is a side view of the pedal arm and pedal pad as it is being adjusted in accordance with the invention.

As shown in FIG. 3, the elongated pedal 32 permits the user to contact the pedal with the ball of his foot 36 (shown at $A^1$ and $A^2$) while maintaining the heel on the floor 38 of the vehicle regardless of the position of the pedal. The pedal curves downwardly and has a length of approximately six inches. The curvature of the pedal arm is chosen to increase in the radius of curvature as it curves downwardly to provide clearance for the sole of the foot when the pedal is moved rearwardly. Thus, the contact point of the ball of the foot 36 is permitted to move from the upper portion of the pedal from $A^1$ when at the retracted position to the lower portion of the pedal 32 at $A^2$ downwardly as the pedal arm 26 is adjusted rearwardly to the extended position.

Thus disclosed is a compact pedal adjustment arrangement which provides for the adjustment utilizing the minimum amount of space.

What is claimed is:

1. An adjustment assembly for adjusting the position of a pedal arm in a vehicle, said adjustment assembly comprising:

a support bracket mounted to said vehicle;

a support arm having one end pivotally mounted to said bracket;

a pedal arm pivotally mounted to another end of said support arm;

an adjustment mechanism extending between said support arm and said pedal arm, said adjustment mechanism having a screw rod attached to one of said pedal arm and said support arm to selectively position the pedal at a desired position between a retracted position and an extended position; and an electronic control mounted to said bracket, said electronic control providing a signal indicative of a position of said arm assembly.

2. The adjustment assembly of claim 1 wherein said support arm has a portion extending in a direction outwardly from said bracket over said adjustment mechanism.

3. The adjustment assembly of claim 2 wherein said pedal arm has an upper portion and a lower portion which extends from said upper portion in a direction towards said bracket and under said adjustment mechanism.

4. The adjustment assembly of claim 1 further comprising a motor mounted to said bracket and a drive cable connecting said motor to said adjustment mechanism.

5. The adjustment assembly of claim 1 wherein said support arm includes a vertically extending portion and said pedal arm has an upper portion which is substantially parallel to said vertically extending portion of said support arm when said pedal arm is in said retracted position.

6. The adjustment assembly of claim 5 wherein said adjustment mechanism extends between said vertically extending portion of said support arm and said upper portion of said pedal arm.

7. An adjustment assembly for adjusting the position of a pedal arm in a vehicle, said adjustment assembly comprising:

a support bracket mounted to said vehicle;

a support arm having one end pivotally mounted to said bracket, said support arm having a lower portion and an upper portion extending in a direction outwardly from said bracket;

a pedal arm pivotally mounted to another end of said support arm, said pedal arm having a lower portion which extends in a direction towards said bracket;

an adjustment mechanism extending between said support arm and said pedal arm, said adjustment mechanism having a screw rod attached to one of said pedal arm and said support arm to selectively position the pedal at a desired position between a retracted position and an extended position, said adjustment mechanism extending between said upper portion of said support arm and an upper portion of said pedal arm; and an electronic control mounted to said bracket, said electronic control providing a signal indicative of a position of said pedal arm.

8. The adjustment assembly of claim 7 further comprising a motor mounted to said bracket and a drive cable connecting said motor to said adjustment mechanism.

* * * * *